US007973497B2

(12) United States Patent
Nishida et al.

(10) Patent No.: US 7,973,497 B2
(45) Date of Patent: Jul. 5, 2011

(54) DISCHARGE TUBE LIGHTING APPARATUS

(75) Inventors: Akio Nishida, Kyoto (JP); Shigeru Arai, Sakai (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 349 days.

(21) Appl. No.: 12/403,432

(22) Filed: Mar. 13, 2009

(65) Prior Publication Data

US 2009/0160352 A1 Jun. 25, 2009

Related U.S. Application Data

(63) Continuation of application No. PCT/JP2007/069647, filed on Oct. 9, 2007.

(30) Foreign Application Priority Data

Nov. 16, 2006 (JP) ..... 2006-310045

(51) Int. Cl.
*G05F 1/00* (2006.01)

(52) U.S. Cl. ..... 315/307; 315/308; 315/209 R

(58) Field of Classification Search ..... 315/177, 315/186, 193, 200 R, 201, 205, 206, 209 R, 315/210, 219, 220, 225, 226, 246, 247, 250, 315/254, 255, 256, 257, 258, 265, 266, 272, 315/274, 276, 277, 278, 279, 283, 287, 289, 315/291, 294, 297, 299, 300, 307, 308, 312, 315/313, 320, 324, 326, 352, 354, 356, 362
See application file for complete search history.

(56) References Cited

U.S. PATENT DOCUMENTS

| | | | | |
|---|---|---|---|---|
| 5,479,208 | A * | 12/1995 | Okumura | 348/301 |
| 5,559,395 | A * | 9/1996 | Venkitasubrahmanian et al. | 315/247 |
| 5,751,115 | A * | 5/1998 | Jayaraman et al. | 315/225 |
| 5,914,572 | A * | 6/1999 | Qian et al. | 315/307 |
| 6,639,369 | B2 | 10/2003 | Ribarich | |
| 6,958,580 | B2 * | 10/2005 | Kamoi et al. | 315/291 |

FOREIGN PATENT DOCUMENTS

| | | | |
|---|---|---|---|
| JP | 11-122937 | A | 4/1999 |
| JP | 2000-357599 | A | 12/2000 |
| JP | 3752222 | B2 | 3/2006 |

OTHER PUBLICATIONS

Official Communication issued in International Patent Application No. PCT/JP2007/069647, mailed on Dec. 11, 2007.

* cited by examiner

*Primary Examiner* — Douglas W Owens
*Assistant Examiner* — Jianzi Chen
(74) *Attorney, Agent, or Firm* — Keating & Bennett, LLP

(57) ABSTRACT

A discharge tube lighting apparatus includes a converter that converts a voltage received from an alternating-current or direct-current power supply into a predetermined direct-current voltage and an inverter that converts an output voltage of the converter into an alternating-current voltage having a predetermined frequency. The inverter performs burst control based on an externally input dimming signal. The converter operates regardless of the active or inactive period of the burst control of the inverter and performs negative feedback control in response to a detection signal of a tube current in the active period of the inverter.

5 Claims, 6 Drawing Sheets

DISCHARGE TUBE LIGHTING APPARATUS

BACKGROUND OF THE INVENTION

1. Field of the Invention

The present invention relates to a discharge tube lighting apparatus for lighting a discharge tube, such as a cold-cathode tube for use in a backlight in, for example, a liquid crystal display.

2. Description of the Related Art

A typical induction motor and inverter that drives a high-intensity discharge (HID) lamp adjusts its output power by controlling a peak value. Japanese Unexamined Patent Application Publication No. 6-105563 discloses a circuit that includes a power-factor correction (PFC) converter that performs pulse-amplitude modulation (PAM) control during heavy loading and pulse-width modulation (PWM) control during light loading to expand a range of controlling the output power and an inverter receiving the output of the converter and driving an induction motor. Japanese Patent No. 3752222 discloses a circuit that includes a PFC converter and an inverter that receives the output of the converter and drives a HID lamp.

A power supply for a backlight in, for example, a liquid crystal display is required to supply power in a wider range of power supplying a power to an inverter than that for an induction motor or an HID lamp. This is because the backlight is usually used in a dark room with a low luminance and it is necessary to increase the luminance of the backlight in a bright room. If that control is made by PWM, a reduction in peak value of a voltage input to the inverter or a voltage distortion (a phenomenon in which the voltage deviates significantly from a sine wave shape) may occur when the luminance is low. This may cause the backlight to flicker or the backlight may not be properly lit. To address this problem, burst control as disclosed in Japanese Unexamined Patent Application Publication No. 11-122937 is used.

Here, the backlight control device illustrated in Japanese Unexamined Patent Application Publication No. 11-122937 is described with reference to FIG. 1.

In FIG. 1, a current passing through a fluorescent lamp 4 is detected by a resistor R4 as a voltage signal and is rectified by a diode D1 and a capacitor C3, and a mean voltage is extracted. The mean voltage and a dimming voltage Vcon are divided by a resistor R1 and a resistor R2 and input to a dimming control circuit 1. The dimming control circuit 1 outputs an on-off signal to duty-control a transistor Q1 at a frequency in the range of from a fraction of to several-tenths of an oscillating frequency of the inverter circuit, using the input voltage, and the transistor Q1 controls the voltage to be input to the inverter circuit. That is, when the dimming voltage Vcon decreases, the voltage input to the dimming control circuit 1 decreases, such that the dimming control circuit 1 operates so as to extend the period in which the transistor Q1 is in an ON state and to increase the length of the period in which a current passes through the fluorescent lamp 4. In contrast, when the dimming voltage Vcon increases, the voltage input to the dimming control circuit 1 increases, such that the dimming control circuit 1 operates so as to reduce the period in which the transistor Q1 is an ON state and to reduce the length of the period for which a current passes through the fluorescent lamp 4. The ratio between the period in which the fluorescent lamp is illuminated and the period in which the fluorescent lamp is not illuminated at that time changes the intensity of the backlight.

The voltage to be input to the inverter circuit is extracted as a voltage divided by a resistor R5 and a resistor R6, and the detected voltage is input to an input-voltage control circuit 2. The input-voltage control circuit 2 outputs an on-off signal to duty-control the transistor Q1 at a frequency that is twice the oscillating frequency of the inverter circuit, using that input voltage, and the transistor Q1 limits the voltage to be input to the inverter circuit to a preset value.

The on-off signals output from the dimming control circuit 1 and the input-voltage control circuit 2 are ORed by a logic circuit 3, thereby allowing the transistor Q1 to perform burst control and PWM control.

However, in the backlight control device disclosed in Japanese Unexamined Patent Application Publication No. 11-122937, because of the effects of the burst operation of the converter at a previous stage, the input current is a pulse current. Thus, if a circuit including only Q1 and L1 at a previous stage is a PFC converter, when the tube current of a cold-cathode tube that is a load is fed back and the output voltage of the PFC (voltage to be input to the inverter circuit) is subjected to burst control, the tube current would also be reduced and the PFC would not normally operate during the period in which the inverter circuit is inactive, so the power factor would be degraded.

Recently, there is a trend in liquid crystal televisions and other products to drive a cold-cathode tube lighting apparatus requiring a relatively high voltage and other loads, including a central processing unit (CPU), using a shared power supply circuit. However, if the converter is subjected to burst control, the entire circuit is inactive when the converter at a previous stage is inactive due to the burst control. Therefore, a problem arises in which the output voltage of the converter at the previous stage can be used only in an input to the inverter.

SUMMARY OF THE INVENTION

To overcome the problems described above, preferred embodiments of the present invention provide a discharge tube lighting apparatus capable of freely adjusting an output power of an inverter, having a substantially sinusoidal waveform of the output voltage of the inverter, having a substantially constant output voltage of a converter at a stage prior to the inverter regardless of the active or inactive period caused by burst control, and utilizing that output voltage in other loads.

A preferred embodiment of the present invention provides a discharge tube lighting apparatus including a converter and an inverter. The converter converts a power supply voltage received from an alternating-current power supply or a direct-current power supply into a direct-current voltage. The inverter performs a switching operation at a predetermined switching frequency, converts an output voltage of the converter into an alternating-current voltage, and outputs the alternating-current voltage to a discharge tube.

The inverter includes a switching circuit arranged to perform the switching operation with a substantially constant on-duty ratio and a burst control circuit arranged to perform burst control in which active and inactive states are repeated at a frequency that is sufficiently less than the switching frequency and to control a ratio between an active period and an inactive period of the burst based on an externally input control signal.

The converter operates regardless of the active or inactive state of the burst control in the inverter and includes a negative feedback control circuit arranged to stabilize a voltage or a current of the discharge tube in response to a detection signal of the voltage or the current of the discharge tube.

The discharge tube lighting apparatus further includes a load detecting circuit arranged to detect the voltage or the current of the discharge tube in the active period of the burst control in the inverter and to supply the detection signal to the converter.

The discharge tube lighting apparatus may preferably further include a tube current detecting circuit that detects the tube current of the discharge tube. The tube current detecting circuit may preferably detect the tube current in at least a portion of the active period of the burst control and set a mean value of the tube current in that period function as the detection signal.

The converter may preferably be, for example, a converter that includes an inductive reactance element, a switching element that receives a voltage from a commercial alternating-current power supply and interrupts an input current to the inductive reactance element, a rectifier smoothing circuit that rectifies and smoothes an energy stored in the inductive reactance element and outputs the result, and a switching control circuit that switches the switching element such that an input current from the commercial alternating-current power supply changes substantially similarly to the voltage of the commercial alternating-current power supply. The converter improves a power factor.

The converter may preferably be, for example, an insulated converter that includes an isolation transformer.

The inverter may preferably be, for example, an insulated inverter that includes an isolation transformer.

According to various preferred embodiments of the present invention, the output of the inverter can be adjusted over a wide range by burst control. The inverter performs a switching operation with a substantially constant on-duty ratio. Therefore, the duty ratio can be set relatively high, and the output of the inverter can have a substantially sine wave shape. In addition, although the inverter performs the burst control, the output to the discharge tube is stabilized by negative feedback control of the converter.

Because the converter operates independently of burst control, the converter can also supply a power to a load other than the discharge tube.

According to various preferred embodiments of the present invention, feeding the mean value of the tube current in an active period of the burst control back to the converter as the detection signal enables accurate detection of the tube current and enables stabilized voltage control in the inactive period of the burst control.

According to various preferred embodiments of the present invention, the converter (PFC converter) having the function of improving a power factor and including the inductive reactance element, the switching element arranged to receive a voltage from the commercial alternating-current power supply and to interrupt an input current to the inductive reactance element, the rectifier smoothing circuit arranged to rectify and smooth an energy stored in the inductive reactance element and to output the result, and the switching control circuit arranged to control the on-duty ratio of the switching element such that the input current from the commercial alternating-current power supply changes substantially similarly to the voltage of the commercial alternating-current power supply can be used as the converter to supply a power to the inverter performing the burst control. Thus, a reduction in the power factor and the occurrence of harmonic currents are effectively prevented. That is, even when the inverter performs a burst operation, the PFC converter provides an improved power factor that is a load having a high power factor when viewed from the commercial alternating-current power supply. Accordingly, the occurrence of harmonic currents can also be effectively prevented.

According to various preferred embodiments of the present invention, the use of the insulated converter that includes the isolation transformer can achieve reinforced insulation with a simple configuration even when the reinforced insulation is necessary to an input from the commercial alternating-current power supply, as in, for example, a discharge tube lighting apparatus used for a liquid-crystal backlight.

Similarly, the use of the insulated inverter that includes the isolation transformer can achieve reinforced insulation with a simple configuration.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

Figure 1:
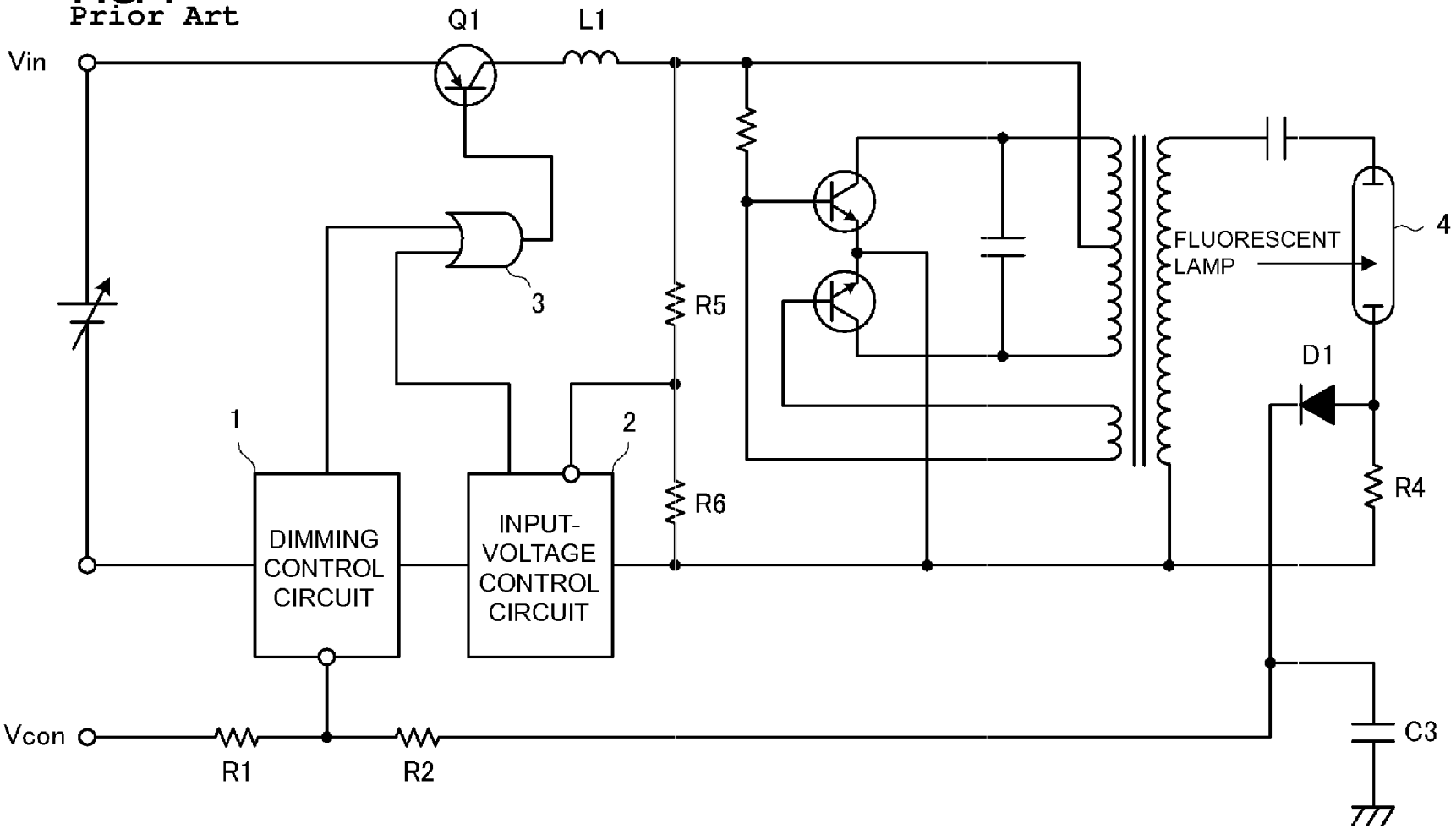
FIG. 1 Prior Art
FIG. 1 is a circuit diagram of a backlight control device according to the related art.
Figure 2:
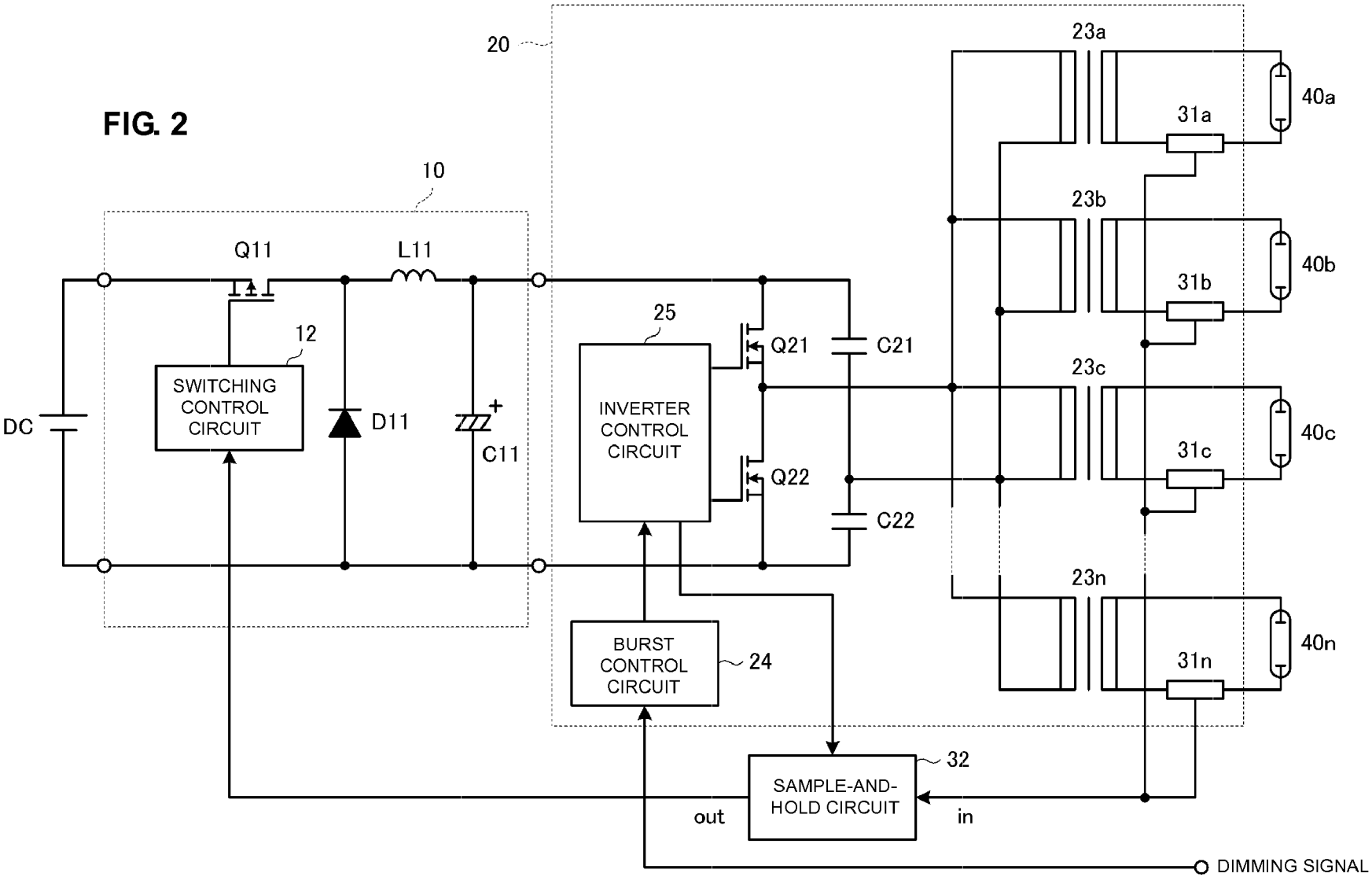
FIG. 2 is a circuit diagram of a discharge tube lighting apparatus according to a first preferred embodiment of the present invention.

FIG. 2 is a circuit diagram of a discharge tube lighting apparatus according to a first preferred embodiment of the present invention. The discharge tube lighting apparatus includes a converter 10 arranged to receive a direct-current power supply DC and to output a predetermined direct-current voltage and an inverter 20 arranged to receive an output voltage of the converter 10, to output an alternating-current high voltage, and to light discharge tubes 40*a*, 40*b*, 40*c*, . . . , 40*n*. The converter 10 includes a switching transistor Q11, an inductor (inductive reactance element) L11, a diode D11, a capacitor C11, and a switching control circuit 12 arranged to control the switching transistor Q11. The converter 10 defines a step-down switching regulator and controls the ratio of an output voltage to an input voltage using the on-duty ratio of the switching transistor Q11 controlled by the switching control circuit 12.

The inverter 20 includes switching elements Q21 and Q22, capacitors C21 and C22, inverter transformers 23*a*, 23*b*, 23*c*, . . . , 23*n*, an inverter control circuit 25 arranged to control the switching elements Q21 and Q22, and a burst control circuit 24 arranged to perform burst control on the inverter control circuit 25. The inverter 20 defines a half-bridge inverter circuit and preferably alternately turns on and off the switching elements Q21 and Q22 with an on-duty ratio of approximately 50%. This produces a voltage having a substantially sinusoidal waveform at the secondary side of the inverter transformers 23*a* to 23*n* and applies a predetermined high voltage to each of the discharge tubes (cold-cathode tubes) 40*a* to 40*n*.

Tube current detecting circuits 31*a* to 31*n* are disposed in series adjacent to the secondary side of the inverter transformers 23*a* to 23*n*. These tube current detecting circuits 31*a* to 31*n* extract a voltage drop across the resistance as a current (tube current) passing through the secondary side of the respective inverter transformers 23*a* to 23*n*, amplifies it with a substantially constant gain, and outputs the resultant as a voltage signal that is approximately proportional to the tube current.

A sample-and-hold circuit 32 receives a voltage in which output voltages of the plurality of tube current detecting circuits 31*a* to 31*n* are combined, performs sampling and holding at a timing of a sample-and-hold switching signal supplied from the inverter control circuit 25, and feeds its voltage signal back to the switching control circuit 12. The inverter control circuit 25 generates a sample-and-hold switching signal such that sampling is executed at a predetermined timing within an on period of burst control and outputs the sample-and-hold switching signal to the sample-and-hold circuit 32.

The tube current detecting circuit 31 and the sample-and-hold circuit 32 define a load detecting circuit according to this preferred embodiment of the present invention. The switching control circuit 12 defines a negative feedback circuit.

The burst control circuit 24 performs burst control on the inverter control circuit 25 in response to an externally supplied dimming signal. That is, active periods and inactive periods are alternately provided, and the ratio between the active periods and the inactive periods is determined. To increase the luminance of the discharge tubes 40*a* to 40*n* in response to an externally supplied dimming signal, a mean output power of the inverter 20 is preferably increased by increasing the ratio (of the active periods/the inactive periods) of the inverter control circuit 25. In contrast, to reduce the luminance of the discharge tubes 40*a* to 40*n*, a mean output power of the inverter 20 is preferably reduced by reducing the ratio (of the active periods/the inactive periods) of the inverter control circuit 25. Selecting this burst frequency such that it is high enough so that a human will not observe flickering and sufficiently less than the switching frequency of the inverter enables flicker-free dimming control using burst control.

The converter is not subjected to burst control, but the inverter is subjected to burst control, so the converter always operates independently of the burst control. Thus, an output voltage of the converter can preferably also be used for circuits other than an input to the inverter, for example, a control circuit, including a CPU.

Figure 3B:
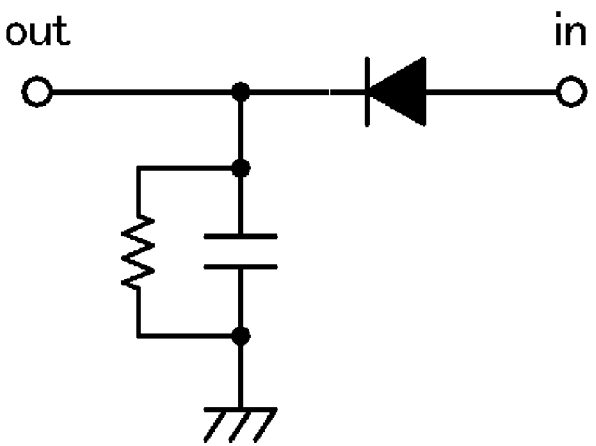
FIGS. 3A and 3B illustrate an example of a sample-and-hold circuit and other components of the discharge tube lighting apparatus.
Figure 3A:
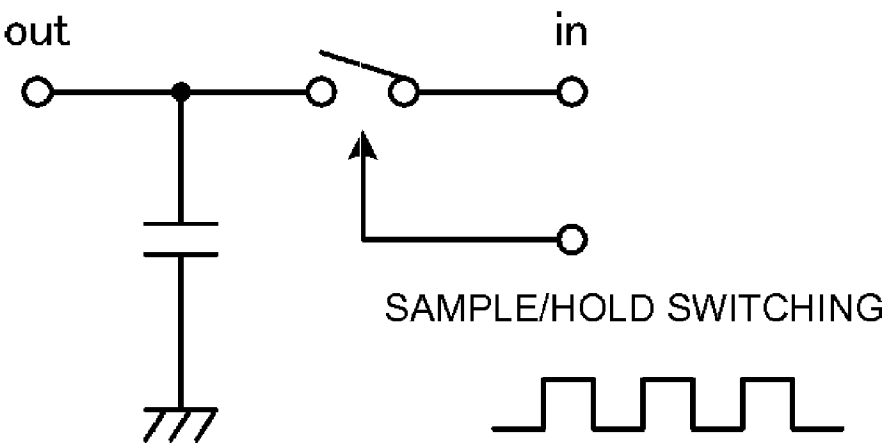

FIG. 3A illustrates a configuration of the sample-and-hold circuit 32 illustrated in FIG. 2. The sample-and-hold circuit includes a switching element disposed at an input side and a capacitor that holds a voltage applied through the switching element, as illustrated in FIG. 3A. If required, the sample-and-hold circuit may preferably include an operational amplifier that receives a charge voltage of the capacitor with high impedance and that amplifies it.

Such a configuration enables holding a voltage that is approximately proportional to the tube current occurring when the inverter control circuit 25 is in a continuity period of burst control by interrupting the switching element in response to a sample-and-hold switching signal supplied from the inverter control circuit 25, as illustrated in FIG. 2.

FIG. 3B illustrates an example of a circuit that is not based on a sample-and-hold switching signal. As illustrated in FIG. 3B, the example includes a diode, a capacitor, and a resistor. The circuit charges the capacitor with a substantially peak voltage of a varying input voltage and outputs it. The circuit defines a peak hold circuit. In a period in which the inverter control circuit 25 illustrated in FIG. 2 maintains an off state of both the switching elements Q21 and Q22 by control of the burst control circuit 24 (burst-control inactive periods), the tube current is substantially zero, whereas in a burst-control active period, the tube current occurs. Thus, a voltage signal that is preferably approximately proportional to a tube current occurring when the discharge tubes 40*a* to 40*n* are illuminated can be extracted by the detection of a peak voltage of the tube current.

The sample-and-hold circuit 32 illustrated in FIG. 2 may be preferably configured to obtain a mean value of a voltage signal that is approximately proportional to the tube current in an active period in burst control of the inverter 20. The mean value may be detected in a portion of an active period. When the inverter 20 is subjected to burst control, variations in tube current are greater than those occurring when the inverter 20 continuously operates. However, by obtaining the mean value of the tube current in an active period, as described above, adverse effects caused by the variations in the tube current in the active period in burst control can be prevented.

Second Preferred Embodiment

Figure 4:
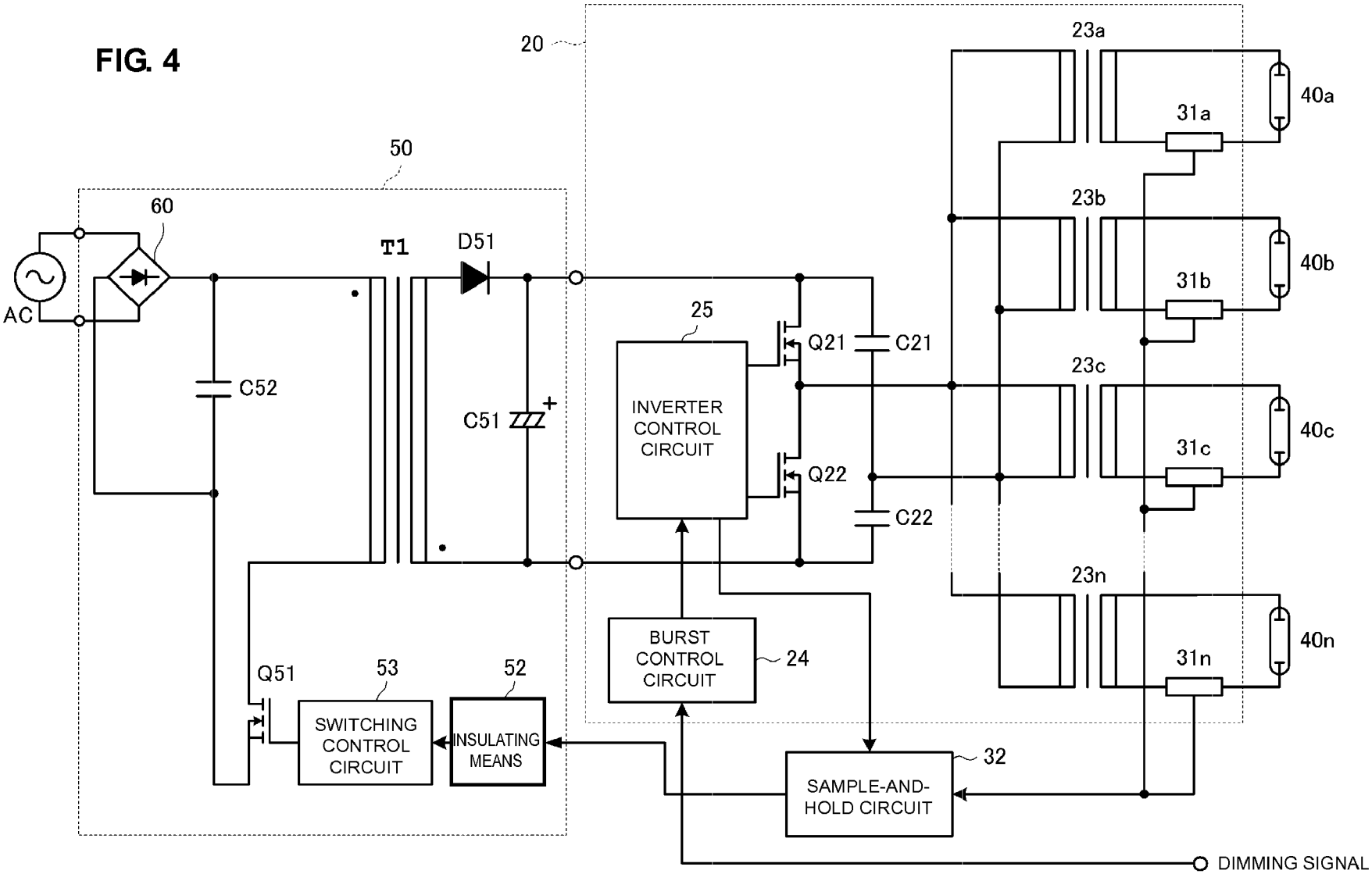
FIG. 4 is a circuit diagram of a discharge tube lighting apparatus according to a second preferred embodiment of the present invention.

FIG. 4 is a circuit diagram of a discharge tube lighting apparatus according to a second preferred embodiment of the present invention. In the first preferred embodiment, a step-down chopper circuit is provided as a converter that supplies a power to the inverter. In the second preferred embodiment, a flyback insulated power-factor correction (PFC) converter that includes an isolation transformer T1 (inductive reactance element according to the present preferred embodiment) is provided. The insulated PFC converter 50 includes a diode bridge 60, a capacitor C52 arranged to reduce noise, the isolation transformer T1, a rectifier diode D51, a smoothing capacitor C51, a switching element Q51, a switching control circuit 53, and insulating circuit 52 arranged to supply a feedback signal in an insulated state to the switching control circuit 53.

A commercial alternating-current power supply AC is applied to the insulated PFC converter 50. The capacitor C52 is not a smoothing capacitor but is a low-capacitance capacitor used to reduce noise. A voltage having a full-wave rectification shape is applied to the primary side of the isolation transformer T1 through the diode bridge 60.

The switching control circuit 53 stabilizes an output voltage by controlling the on-duty ratio of the switching element Q51 and controls an input current to the insulated PFC converter 50 such that the input current preferably has a substantially sinusoidal waveform. This enables high power-factor operation.

The configuration of the inverter 20 illustrated in FIG. 4 is substantially the same as that of the inverter 20 illustrated in FIG. 2. The insulating circuit 52 supplies an output voltage of the sample-and-hold circuit 32 to the switching control circuit 53 as a detection signal using, for example, a photocoupler.

Figures 5A, 5B, 5C:
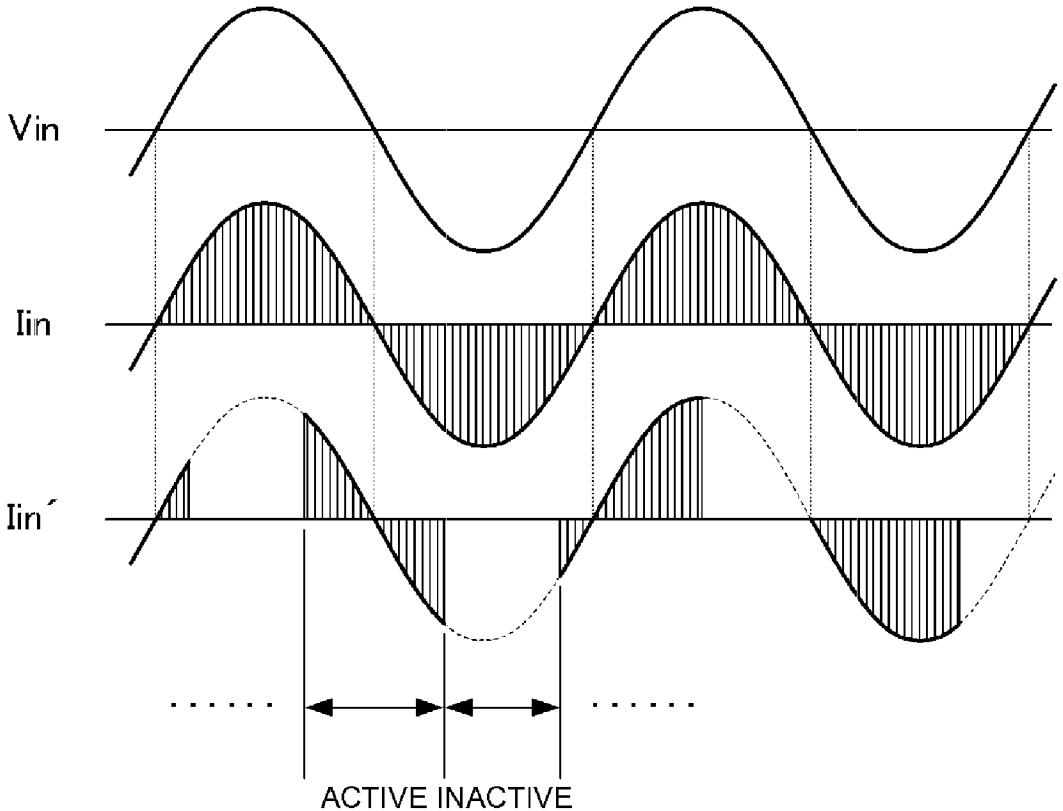
FIGS. 5A to 5C illustrate waveforms to describe an operation of an insulated PFC converter of the discharge tube lighting apparatus.

FIGS. 5A to 5C illustrate waveforms that indicate an operation of the insulated PFC converter 50 illustrated in FIG. 4. FIG. 5A illustrates a waveform of an input voltage of the commercial alternating-current power supply AC; FIG. 5B illustrates a waveform of an input current of the insulated PFC converter 50. As illustrated, the envelope of the input-current waveform is similar to that of the input-voltage waveform.

If the switching element Q51 of the insulated PFC converter 50 illustrated in FIG. 4 is subjected to burst control for dimming, a current would pass in an active period of the burst control and be shut off in an inactive period, as illustrated in FIG. 5C. The power factor would be reduced, and the input current would have a high harmonic content. That is, it would not function as a PFC converter. In contrast, according to the second preferred embodiment, burst control for dimming is performed in the inverter and is not performed in the converter. Therefore, a high power-factor characteristic can be maintained.

Third Preferred Embodiment

Figure 6:
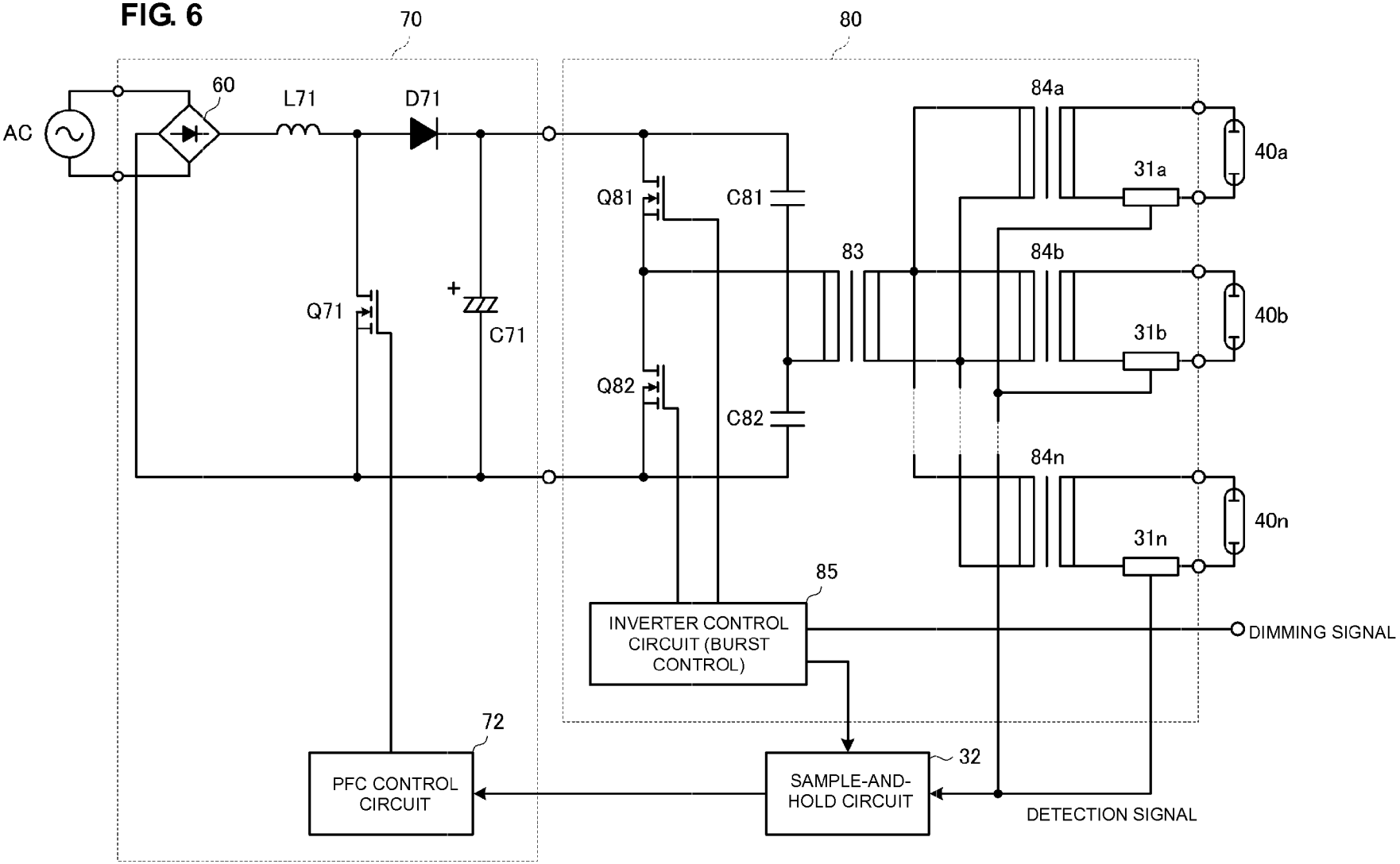
FIG. 6 is a circuit diagram of a discharge tube lighting apparatus according to a third preferred embodiment of the present invention.

FIG. 6 is a circuit diagram of a discharge tube lighting apparatus according to a third preferred embodiment of the present invention. In the present preferred embodiment, the discharge tube lighting apparatus includes a non-insulated PFC converter and an insulated PFC inverter. The non-insulated PFC converter 70 includes a diode bridge 60, an inductor L71, a diode D71, a capacitor C71, a switching element Q71, and a PFC control circuit 72. This configuration defines a step-up chopper circuit. The PFC control circuit 72 performs on-off control of the switching element Q71 such that a current having a substantial sine waveform is input into the non-insulated PFC converter 70.

The insulated inverter 80 includes two switching elements Q81 and Q82, capacitors C81 and C82, an isolation transformer 83, high-voltage transformers 84*a*, 84*b*, . . . , 84*n*, tube current detecting circuits 31*a*, 31*b*, . . . , 31*n*, and an inverter control circuit 85 containing a burst control circuit.

The sample-and-hold circuit 32 samples and holds an output signal of each of the tube current detecting circuits 31*a* to 31*n* in response to a sample-and-hold switching signal from the inverter control circuit 85 and feeds it back to the PFC control circuit 72.

The inverter control circuit 85 preferably includes the inverter control circuit 25 and the burst control circuit 24 illustrated in FIG. 2. The inverter control circuit 85 performs inverter control active and inactive by turning on and off the switching elements Q81 and Q82 in an alternating manner in response to an externally supplied dimming signal.

The input portion arranged to receive a dimming signal to the inverter control circuit 85 and the input portion of the sample-and-hold circuit 32 are arranged to be insulated when receiving a signal. This configuration provided an insulated discharge tube lighting circuit, such that when reinforced insulation to an input from a commercial alternating-current power supply is required, it is obtained with a simple configuration.

In the first to third preferred embodiments, the current passing through a discharge tube is preferably detected by the tube current detecting circuit 31, and a voltage is subjected to negative feedback control such that the above-described tube current remains substantially constant. However, the voltage applied to the discharge tube may be detected, and the voltage supplied to the inverter may be subjected to negative feedback control such that the detected voltage remains substantially constant.

Preferred embodiments the present invention can be used with any suitable inverter type at a subsequent stage, e.g., half-bridge, full-bridge, push-pull type.

In the first to third preferred embodiments, the number of discharge tubes is preferably greater than one. However, preferred embodiments of the present invention can be used with a single discharge tube.

In the first to third preferred embodiments, a single discharge tube is driven for a single inverter transformer. However, there may be various configurations of inverter transformers and discharge tubes. For example, a plurality of discharge tubes may be driven by a single inverter transformer, and a single discharge tube may be driven by two inverter transformers.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A discharge tube lighting apparatus comprising:

a converter arranged to convert a power supply voltage received from an alternating-current power supply or a direct-current power supply into a direct-current voltage; and an inverter arranged to perform a switching operation at a switching frequency, to convert an output voltage of the converter into an alternating-current voltage, and to output the alternating-current voltage to a discharge tube; wherein the inverter includes a switching circuit arranged to perform the switching operation with a substantially constant on-duty ratio and a burst control circuit arranged to perform burst control in which active and inactive states are repeated at a frequency that is less than the switching frequency and to control a ratio between an active period and an inactive period of the burst based on an externally input control signal; and the converter is arranged to operate regardless of the active or inactive state of the burst control in the inverter and includes a negative feedback control circuit arranged to stabilize a voltage or a current of the discharge tube in response to a detection signal of the voltage or the current of the discharge tube;

the discharge tube lighting apparatus further comprising:

a load detecting circuit arranged to detect the voltage or the current of the discharge tube in the active period of the burst control in the inverter and to supply the detection signal to the converter.

2. The discharge tube lighting apparatus according to claim 1, further comprising:

a tube current detecting circuit arranged to detect the tube current of the discharge tube in at least a portion of the active period of the burst control and to set a mean value of the tube current in that period as the detection signal.

3. The discharge tube lighting apparatus according to claim 1, wherein the converter includes an inductive reactance element, a switching element arranged to receive a voltage from a commercial alternating-current power supply and to interrupt an input current to the inductive reactance element, a rectifier smoothing circuit arranged to rectify and smooth an energy stored in the inductive reactance element and to output a result, and a switching control circuit arranged to control an on-duty ratio of the switching element such that an input current from the commercial alternating-current power supply changes substantially similarly to the received voltage.

4. The discharge tube lighting apparatus according to claim 1, wherein the converter is an insulated converter that includes an isolation transformer.

5. The discharge tube lighting apparatus according to claim 1, wherein the inverter is an insulated inverter that includes an isolation transformer.

* * * * *